United States Patent [19]

Winstanley

[11] Patent Number: 4,621,456

[45] Date of Patent: Nov. 11, 1986

[54] GRINDING MACHINE FOR MOWING MACHINE CYLINDER BLADES

[76] Inventor: Ralph Winstanley, Wetmoor Lane, Wath-upon-Dearne, Rotherham S63 7LR, England

[21] Appl. No.: 735,203

[22] Filed: May 17, 1985

[30] Foreign Application Priority Data

Mar. 5, 1985 [GB] United Kingdom ..... 8505655

[51] Int. Cl.[4] ..... B24B 3/42

[52] U.S. Cl. ..... 51/48 HE; 51/249; 51/165.77

[58] Field of Search ..... 51/95 LH, 48 HE, 249, 51/165.77, 246, 248, 262 R

[56] References Cited

U.S. PATENT DOCUMENTS 4,148,158 4/1979 Hewitt ..... 51/48 HE 4,192,103 3/1980 Sousek ..... 51/249

*Primary Examiner*—Frederick R. Schmidt

*Assistant Examiner*—Maurina Rachuba

*Attorney, Agent, or Firm*—William R. Hinds

[57] ABSTRACT

A grinding machine for cylinder type mowing machine blades, the machine including an arrangement for indexing the blade cylinder around from one blade to the next so that it can be completely relief ground in one operation without the intervention of an operative. The machine includes a grinding wheel head which can be traversed to and fro on guides to grind each blade in turn, and a motor unit and a clutch device for driving the blade cylinder when it is required to index the cylinder around from one blade to the next, the motor unit and clutch device being controlled by electronic signals given by proximity switches responsive to the position of the grinding wheel head and to the positioning of the blade cylinder.

8 Claims, 3 Drawing Figures

GRINDING MACHINE FOR MOWING MACHINE CYLINDER BLADES

FIELD OF THE INVENTION

The invention relates to a grinding machine for mowing machine cylinder blades, that is to say for the grinding of a relief angle on the blades of the blade cylinder of a cylinder type mowing machine.

BACKGROUND OF THE INVENTION

Grinding machines for mowing machine cylinder blades are known and comprise means for mounting the blade cylinder for rotation about the axis of its mounting shaft; a grinding wheel mounted on guides for traverse movements longitudinally of the blade cylinder; and a so-called finger guide which is mounted beneath the grinding wheel as a support for each blade of the blade cylinder in turn as grinding takes place, the arrangement being such that as a traverse movement of the grinding wheel head takes place, the abutment of the finger guide against the particular blade concerned causes the blade cylinder to rotate in timed relation to the traverse movement of the grinding wheel head and in the appropriate direction according to the direction of traverse of the grinding wheel head. In this way there is ground a constant amount of back relief along the length of the blade concerned.

Such known grinding machines have one particular drawback, this being that they have been unable to "index" the work cylinder around automatically from one blade to another to enable a blade cylinder to be completely relief ground in one operation without the intervention of an operative. It has been necessary for the operative to manually index the work cylinder around to bring each blade in turn into abutment with the finger guide to enable it to be relief ground by the traversing of the grinding wheel head as previously described. This has caused the grinding of a complete blade cylinder to be a slow process and also a somewhat hazardous one for the operative who has to reach into the machine to grasp hold of the work cylinder in close proximity to the grinding wheel which is rotating at high speed.

It is the object of the invention to provide a grinding machine for mowing machine cylinder blades which will be free of the disadvantages referred to above.

SUMMARY OF THE INVENTION

According to the invention, there is provided a grinding machine for mowing machine cylinder blades; the grinding machine including means for mounting a blade cylinder for rotation about its longitudinal axis; a grinding wheel head mounted on guides for traverse movements longitudinally of the blade cylinder; means for traversing the grinding wheel to and fro on its guides; a finger guide adjustably positioned beneath the grinding wheel as a support for each blade of the blade cylinder in turn as grinding takes place so that as a traverse movement of the grinding wheel takes place the abutment of the finger guide against the particular blade concerned and the abrasive action of the grinding wheel against the blade causes the blade cylinder to rotate in timed relation to the traverse movement of the grinding wheel head and in the appropriate direction according to the direction of traverse of the grinding wheel head; means for driving the blade cylinder when it is required to index the cylinder around from one blade to the next, said means being constituted by a motor unit and a clutch device such that drive is only transmitted from the motor unit to the blade cylinder when the clutch device is engaged by an appropriate signal; and means for triggering into operation the signal required to initiate an indexing rotation of the blade cylinder and for disengaging the clutch device when an appropriate indexing movement has taken place, said means including a pair of detector devices, that is to say a first detector device acting to detect the arrival of the grinding wheel head at one end of its traverse with the grinding wheel and finger guide clear of the blade cylinder and thus triggering into operation the signal required, and a second detector device acting to detect the arrival of the next following blade at a position previously occupied by another blade and thus to cause the disengagement of the clutch device. The pair of detector devices referred to will preferably be a pair of electrical proximity switches, the first proximity switch being triggered by the close proximity of a triggering finger carried by the grinding wheel head when the latter has been traversed clear of one end of the blade cylinder, and the second proximity switch being adjustably located in position close to the path of movement traced by portions of the individual blades of the blade cylinder as the latter rotates, said switch being arranged to become operative, after a short time delay following the triggering of the first proximity switch, to be triggered as it detects the arrival of the next following blade in close proximity to the location of said second proximity switch.

DESCRIPTION OF THE PREFERRED EMBODIMENT

Figure 1:
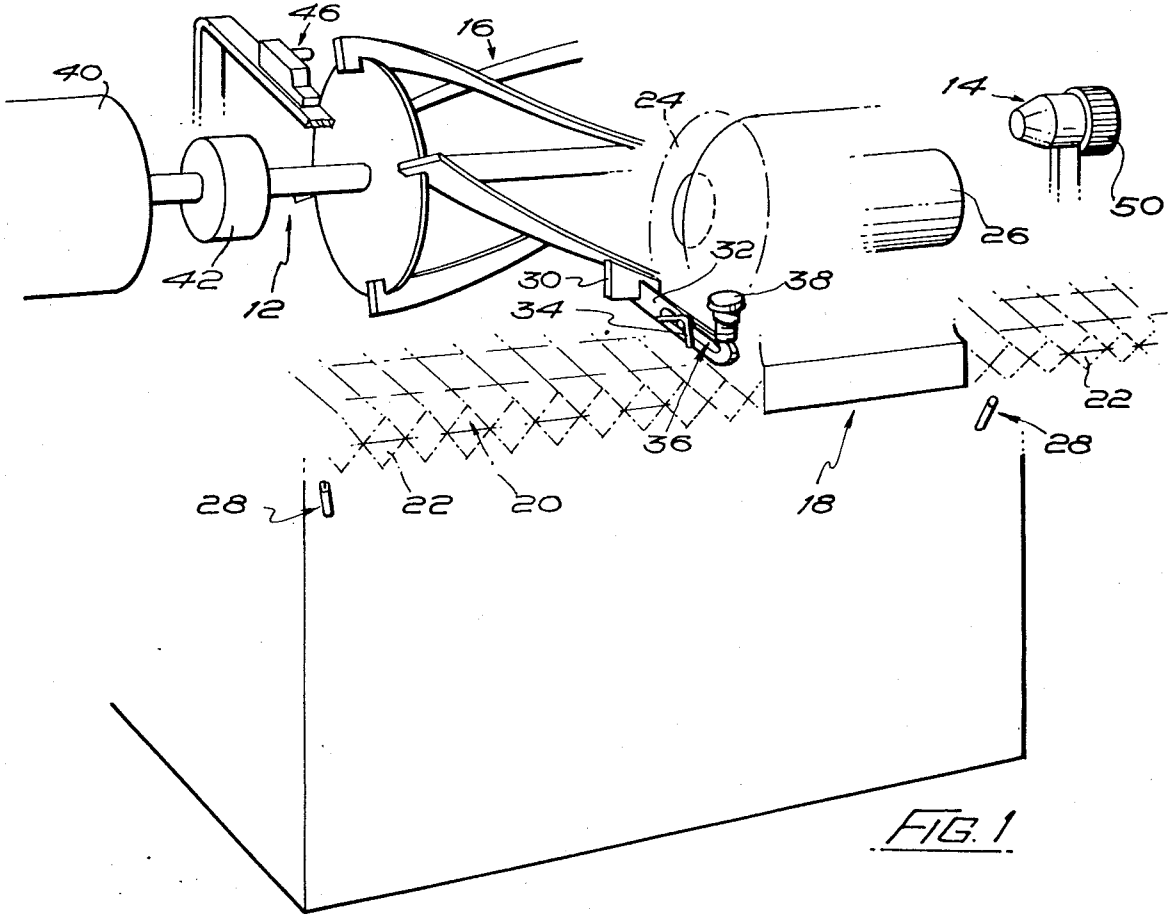
FIG. 1 is a perspective view of a part of a grinding machine embodying the invention.
Figure 2:
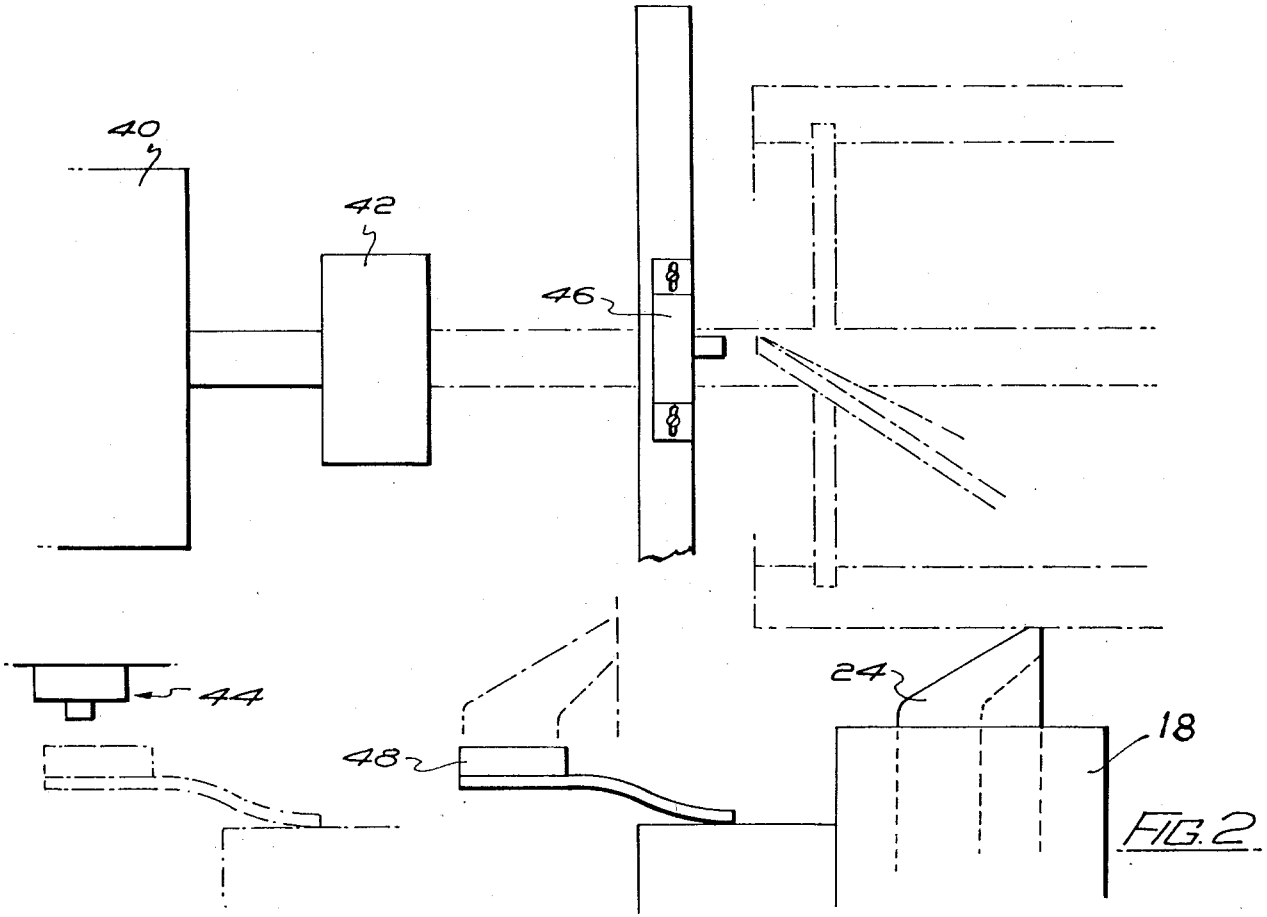
FIG. 2 is a semi-diagrammatic plan view of a part of the machine.

Referring now to FIGS. 1 and 2 of the drawings, the grinding machine there illustrated is mounted on a stout base 10 and includes quick release means, generally indicated 12 and 14, by means of which a blade cylinder 16 of a cylinder type mowing machine can be mounted for rotation about the axis of its mounting shaft. The machine also includes a grinding wheel head, generally indicated 18, mounted on precision guides 20 for traverse movements longitudinally of the blade cylinder. For protection of the guide surfaces these are encased by flexible gaiter members 22,22 on each side of the grinding wheel head. A grinding wheel 24, which is mounted for rotation on the grinding wheel head, is driven by an electric motor 26.

Means for traversing the grinding wheel head to and fro on its guides that is to say longitudinally of the blade cylinder, are not shown but traverse limit stops 28,28 are adjustable along the guides 20 to determine the extent of traverse movement in each direction. A finger guide 30 is adjustably positioned beneath the grinding wheel, being carried by an arm 32 which is clamped in position against the side of the grinding wheel head by means of a wing nut 34. The stud which the wing nut engages extends through a slot 36 in the arm so that the latter is adjustable towards or away from a blade cylinder mounted in the machine. The end of the arm remote from the finger guide is acted on by an adjusting screw 38 by means of which the vertical height of the finger guide can be adjusted.

Referring now in particular to FIG. 2, the machine also includes means for driving the blade cylinder when it is required to index the cylinder around from one blade to the next, these means being constituted by a geared down electric motor unit 40 and a clutch device 42. The arrangement is such that the motor unit runs continuously whilst the machine is in operation but drive is only transmitted to the blade cylinder when the clutch device is engaged by an electrical signal.

Means are provided for triggering into operation the electrical signal required to initiate an indexing rotation of the blade cylinder and for disengaging the clutch device when an appropriate indexing movement has taken place, these means including a pair of proximity switches 44 and 46. The proximity switch 44 is located near the headstock end of the machine and is caused to close by the close proximity of a triggering finger 48, carried by the grinding wheel head, when the latter has been traversed clear of the left hand end of the blade cylinder. The proximity switch 46 is adjustably located in position close to the path of movement traced by the left hand end portions of the individual blades of the blade cylinder (shown in chain-dotted lines in FIG. 2) as the latter rotates; it is arranged to close when it detects the close proximity of the left hand end of one of the blades, that is to say it detects the arrival of the next following blade after an indexing rotation has been initiated by the closure of the proximity switch 44. The switch 46 is arranged to become operative after a short time delay following the closure of the proximity switch 44 so that the indexing movement triggered into operation by the closure of the switch 44 will not be immediately cancelled by the switch 46 detecting the close proximity of the previously positioned blade end. (The manner in which the time delay referred to is effected need not be described since this is something which a skilled electronics engineer will be able to bring about without difficulty).

It will be understood that although the machine is of very simple construction, and can therefore be expected to be very reliable in operation, it is nevertheless extremely versatile and can very quickly be adjusted for the grinding of mowing machine cylinder blades having any number of blades and any blade helix angle. Because the work cylinder is able to rotate freely in either direction during a grinding operation on each blade in turn, being held in engagement with the finger guide by the abrasive engagement of the grinding wheel, the machine is able to grind the blades whatever their helix angle. When the machine is being set up for the grinding of a blade cylinder, or a batch of blade cylinders different from a blade cylinder previously ground, either in its diameter or in its number of blades, the grinding wheel is first brought to an appropriate position relative to the left hand end of one of the blades of the cylinder and then the proximity switch 46 is adjusted in position in closely spaced relation to the next blade end. Consequently, whatever the number of blades on the blade cylinder and whatever their spacing, subsequent indexing movements of the blade cylinder will simply be sufficient to bring blades successively into the position required for engagement between the finger guide and the grinding wheel as the grinding wheel head commences a next traverse movement. It will of course be understood that the vertical adjustment of the finger guide determines the relief angle which will be ground on each blade in turn. The amount of relief imparted to each blade is determined by the adjustment of the grinding wheel towards or away from the axis of the blade cylinder to be ground.

The machine is provided with a frictional device 50 at its tailstock end, and associated with the quick-release means 14, which imparts an adjustable degree of braking to the rotation of the blade cylinder. The purpose of this is to bring the blade cylinder to an immediate halt when the clutch device is disengaged at the completion of an indexing movement.

Figure 3:
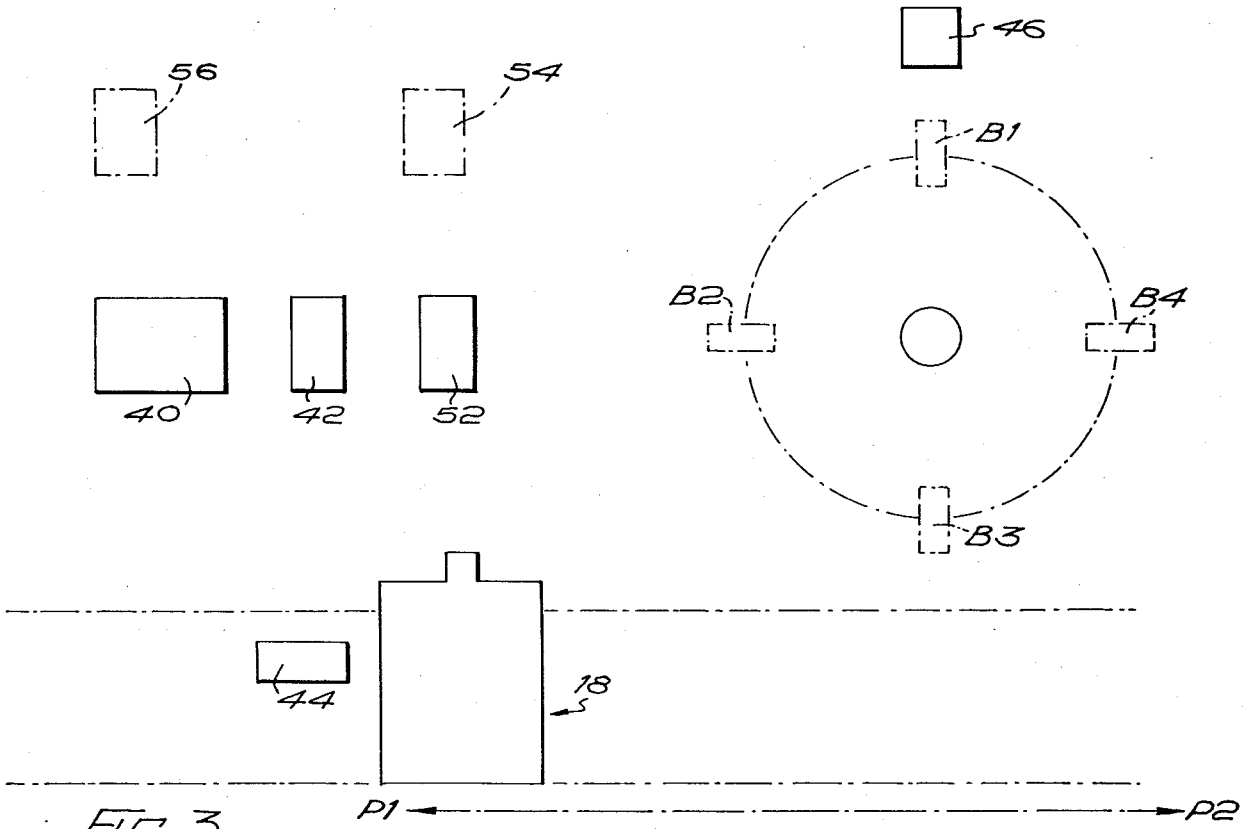
FIG. 3 is a diagrammatic view which will be referred to when describing a possible modification of the machine.

Referring now to FIG. 3, which is a diagrammatic view of a possible modification of the machine described above (and it will be understood that for the sake of clarity the blade cylinder shown in chain-dotted lines at the right of this figure is shown turned through a right angle rather than in side view), the machine there represented is provided with a braking unit 52 instead of with the frictional device 50 of the original machine. The braking unit is associated with the motor unit 40 and clutch device 42, the arrangement being such that when the clutch device is disengaged, the braking unit is applied via a timer 54. A traverse delay timer 56 is also shown in the drawing.

The operation of the modified machine is generally similar to that previously described, as follows:

When proximity switch 44 detects the arrival of the grinding wheel head at position P1, the clutch device 42 is energised causing the blade cylinder to rotate. The commencement of wheel head traverse is delayed by traverse delay timer 56 (by a period of perhaps 1.5 seconds) to allow blade B1 to leave the vicinity of proximity switch 46. Whenever proximity switch 44 is influenced by the close proximity of triggering finger 48, the signals from proximity switch 46 must be overridden to allow the blade present at the start of the grinding sequence in the vicinity of switch 46 to escape outside its range. The grinding wheel head then starts its traverse towards position P2 when the time delay set on timer 56 has elapsed. The timing and speed of traverse and distance of free traverse will be such that blade B2 will have reached proximity switch 46 before the grinding wheel reaches the blade cylinder.

At the instant at which blade B2 influences proximity switch 46 the clutch device 42 is disengaged and at this point the blade sensing circuit is closed down. At that same instant when the clutch device is disengaged, the braking unit is engaged via timer 54 to prevent the blade cylinder from overrunning, that is to say to prevent the blade from moving away from its precisely indexed position. The timer 54 will have been set so that it releases the braking unit at the precise moment when, the finger guide having moved into position beneath the blade about to be ground, the grinding wheel makes contact with the latter. The braking unit now being released, the blade cylinder is free to rotate in timed relation to the traverse movement of the grinding wheel head and in the appropriate direction according to the direction of traverse of the grinding wheel head.

When the grinding wheel head arrives at position P2 its direction of traverse is reversed. As it subsequently arrives at position P1 the indexing sequence is initiated once more as proximity switch 44 is influenced by triggering finger 48.

Various other modifications may be made. For example, for the sake of absolute safety in operation and to guard against the serious consequences of the grinding wheel head commencing a traverse movement if the blade cylinder has not been indexed correctly, there may be provided a further proximity switch operating independently to bring the machine to a halt if the blade cylinder is out of position at the commencement of a traverse movement of the grinding wheel head. Such a further proximity switch may be carried by the grinding wheel head in such a position that its contacts are closed (or alternatively opened) only when the blade cylinder is in an appropriate position for the grinding of a blade at the commencement of a traverse movement.

What I claim and desire to secure by Letters Patent is:

1. A grinding machine for grinding mowing machine cylinder blades and capable of grinding blade cylinders with different numbers of blades without the need for special adaptation between grinding operations on different blade cylinders, the grinding machine including means for mounting a blade cylinder for rotation about its longitudinal axis; a grinding wheel head mounted on guides for traversing movements longitudinally of the blade cylinder; means for traversing the grinding wheel head to and fro on its guides; a finger guide adjustably positioned beneath the grinding wheel as a support for each blade of the blade cylinder in turn as grinding takes place so that as a traverse movement of the grinding wheel takes place the abutment of the finger guide against the particular blade concerned and the abrasive action of the grinding wheel against the blade causes the blade cylinder to rotate in timed relation to the traverse movement of the grinding wheel head and in the appropriate direction according to the direction of traverse of the grinding wheel head; means for driving the blade cylinder when it is required to index the cylinder around from one blade to the next, said means being constituted by a motor unit and a variably engageable and disengageable clutch device such that drive is only transmitted from the motor unit to the blade cylinder while the clutch device is engaged by an appropriate signal; and means for triggering into operation the signal required to initiate an indexing rotation of the blade cylinder and for variably disengaging the clutch device when an appropriate predetermined but variable indexing movement has taken place, said means including a pair of detector devices, that is to say a first detector device acting to detect the arrival of the grinding wheel head at one end of its traverse with the grinding wheel and finger guide clear of the blade cylinder and thus triggering into operation the signal required, and a second detector device acting to detect the variable arrival of the next following blade at a position previously occupied by another blade and thus to cause the disengagement of the clutch device, so that the operation of the machine is independent of the number of blades of the blade cylinder.

2. A grinding machine according to claim 1, in which the pair of detector devices referred to are constituted by a pair of electrical proximity switches, the first proximity switch being triggered by the close proximity of a triggering finger carried by the grinding wheel head when the latter has been traversed clear of one end of the blade cylinder, there being provided means for adjustably locating the second proximity switch in position close to the path of movement traced by portions of the individual blades of the blade cylinder as the latter rotates, means arranging said second switch to become operative, after a short time delay following the triggering of the first proximity switch, to be triggered as it detects the arrival of the next following blade in close proximity to the adjustable location of said second proximity switch so that the operation of the machine is independent of the number of blades of the blade cylinder.

3. A grinding machine according to claim 1, in which the finger guide adjustably positioned beneath the grinding wheel is carried by an arm clamped in position against the side of the grinding wheel head by a screwthreaded fastening.

4. A grinding wheel according to claim 3, in which the screwthreaded fastening engages a slot in the arm by which the finger guide is carried, the arrangement being such that the finger guide is adjustable towards or away from a blade cylinder mounted in the machine.

5. A grinding machine according to claim 4, in which the end of the arm remote from the finger guide is acted on by an adjusting screw by means of which the vertical height of the finger guide can be adjusted.

6. A grinding machine according to claim 1, provided at its tailstock end with a frictional device which imparts a degree of braking to the rotation of the blade cylinder.

7. A grinding machine according to claim 6, in which the frictional device is adjustable so that an adjustable degree of braking can be imparted to the rotation of the blade cylinder.

8. A grinding machine according to claim 1, provided with a braking unit associated with the motor unit and clutch device, the arrangement being such that when the clutch device is disengaged the braking unit is applied via a timer.

* * * * *